US005370008A

United States Patent [19]

Landolt

[11] Patent Number: 5,370,008

[45] Date of Patent: Dec. 6, 1994

[54] STARTER COUPLER FOR AN INTERNAL COMBUSTION ENGINE

[76] Inventor: Gary A. Landolt, 112 W. Main St., Grafton, Ill. 62037

[21] Appl. No.: 783,136

[22] Filed: Oct. 28, 1991

[51] Int. Cl.[5] ..... F02N 15/02

[52] U.S. Cl. ..... 74/7 C; 74/572; 192/42; 192/104 C

[58] Field of Search ..... 74/7 C, 572; 192/42, 192/104 C, 103 B, 105 BB

[56] References Cited

U.S. PATENT DOCUMENTS 1,219,698 3/1917 Brackett ..... 192/42

1,753,825 4/1930 Ford ..... 192/42

*Primary Examiner*—Andrew M. Dolinar

*Attorney, Agent, or Firm*—Polster, Lieder, Woodruff & Lucchesi

[57] ABSTRACT

In an internal combustion engine having a crankshaft and a cranking motor for turning the crankshaft to start the engine, a coupler is attached to the crankshaft and serves as a carrier for a ring gear that is engaged by the cranking motor. The coupler, in effect, disconnects the ring gear from the crankshaft when the crankshaft is operating under its own power, so that the crankshaft is not encumbered by the inertia of the ring gear and thus will accelerate quite rapidly. The coupler includes a hub, which is attached to the crankshaft and is provided with outwardly opening notches, and also includes a drive ring which surrounds the hub, such that it is capable of rotating with respect to the hub. A flexplate is attached to the drive ring, and the ring gear is in turn attached to the flexplate. The drive ring carries pawls which engage the hub at the notches in the hub when the drive ring is turned by the cranking motor with the crankshaft initially at rest, so as to turn the hub and the crankshaft, but the pawls allow the hub to turn in the same direction within the drive ring when the engine starts.

22 Claims, 2 Drawing Sheets

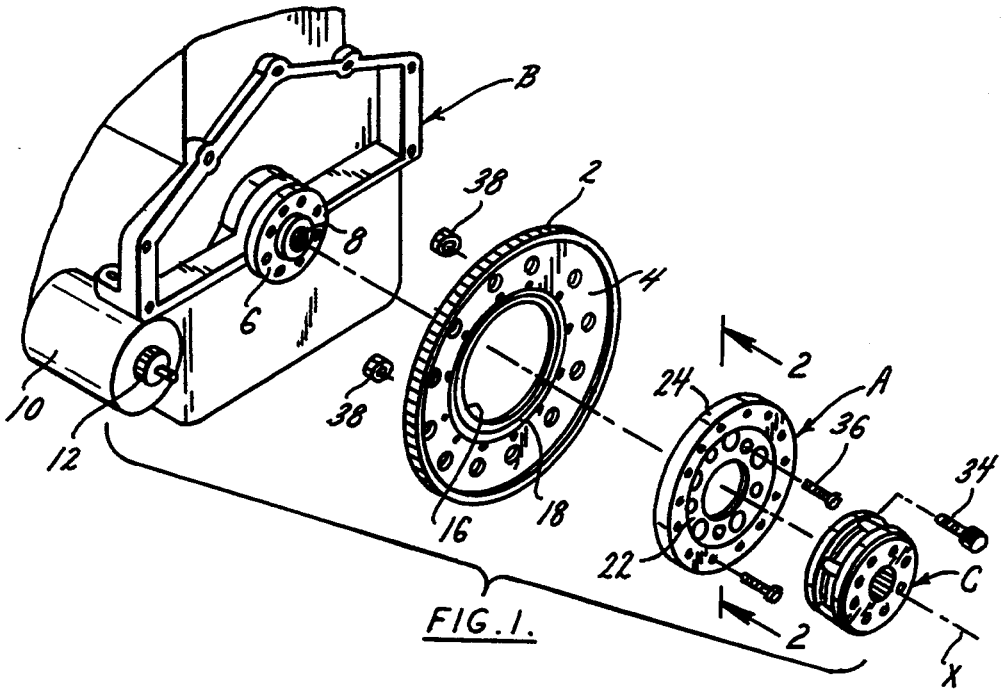
FIG. 1.
FIG. 6.
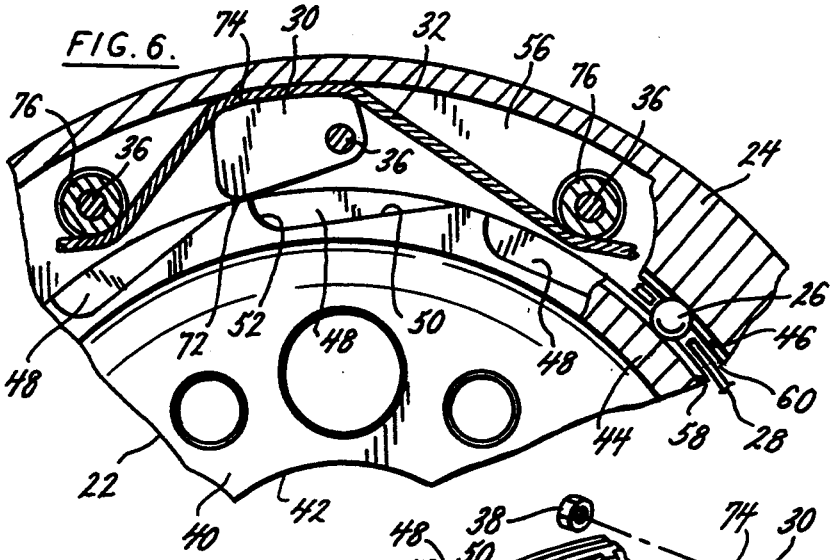
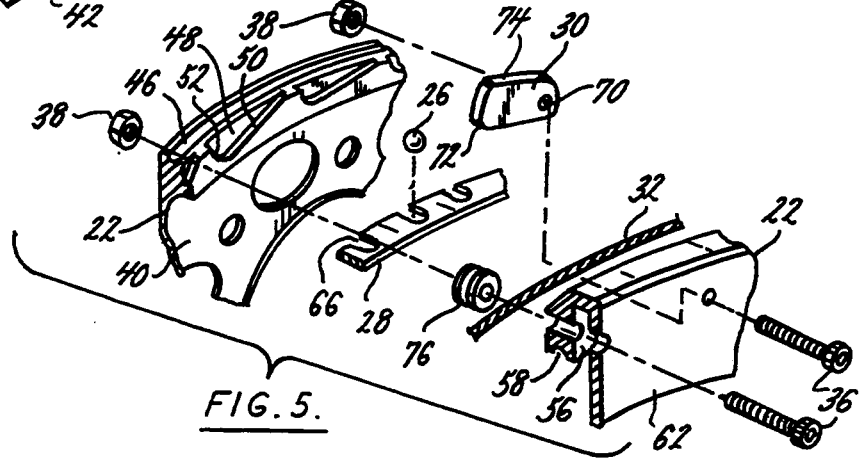
FIG. 5.

STARTER COUPLER FOR AN INTERNAL COMBUSTION ENGINE

BACKGROUND OF THE INVENTION

This invention relates in general to coupling devices, and more particularly to a coupler for connecting a ring gear that is turned by a cranking motor of an internal combustion engine with the crankshaft of the engine for starting the engine.

The conventional automotive engine of the spark ignition type used in automobiles and light trucks, has a relatively heavy flywheel to dampen the torsional pulses imparted by its pistons as those pistons undergo their respective power strokes, and this enables the engine to operate quite smoothly, even when idling at low speeds. While all conventional engines have flywheels which are relatively heavy, the flywheels do not take the same form and vary with the types of transmission through which the engines deliver their power. Where an automatic transmission is used, the housing of the torque converter functions as a flywheel as does the ring gear that is engaged by the starter to crank the engine, the latter being carried by a light plate called a flexplate. On the other hand, where a manual transmission is used, the flywheel assumes a more traditional form. It not only must have enough mass to keep the engine running smoothly at low speeds, but it further must possess sufficient strength to transfer torque to the clutch, for it provides the friction surface against which the clutch plates bear. It also serves as a carrier for the ring gear which the starter engages and in that sense the flywheel used with a manual transmission resembles the flexplate used with an automotive transmission.

Certain high performance engines, such as those used in circle track racing, must have the capacity to accelerate rapidly. They do not require heavy flywheels, because smooth running at idle is sacrificed in favor of acceleration. Aside from that, these engines are rarely equipped with traditional clutches which operate against flywheels. Instead these engines are coupled to their manual transmissions through clutches containing multiple disks of relatively small diameter. Usually the engines used in circle track racing are equipped with the light flexplates identified with automatic transmissions, and then not so much for inertia they provide, but instead as a carrier for the ring gear which the starter engages. In this regard, most promoters of circle track racing open their events only to vehicles having onboard starting. Push starts are not permitted.

But the ring gear on a typical flexplate itself possesses considerable mass—indeed, more than the flexplate itself—and furthermore that mass is concentrated well beyond the axis of rotation. In this regard, the typical ring gear has a diameter 12¾ inches. Thus, the ring gear itself produces a considerable amount of inertia which the engine must overcome to accelerate.

The starter coupler of the present invention carries a ring gear which the pinion of a starting motor engages, and when so engaged the ring gear transmits the torque generated by the starter to the crankshaft of the engine to rotate the same. When the crankshaft of the engine begins to rotate under its own power, the coupler disengages the ring gear from the crankshaft, so that the inertia of the ring gear does not retard acceleration of the crankshaft from a lesser to a greater angular velocity.

DESCRIPTION OF THE DRAWINGS

In the accompanying drawings which form part of the specification and wherein like numerals and letters refer to like parts wherever they occur:

FIG. 1 is an exploded perspective view showing an internal combustion engine, a flex plate, the coupler of the present invention, and a clutch.

FIG. 5 is a fragmentary exploded view showing the components of the coupler, and;

FIG. 6 is a fragmentary sectional view similar to FIG. 2 but showing the pawls disengaged from the hub.

DETAILED DESCRIPTION

Figure 2:
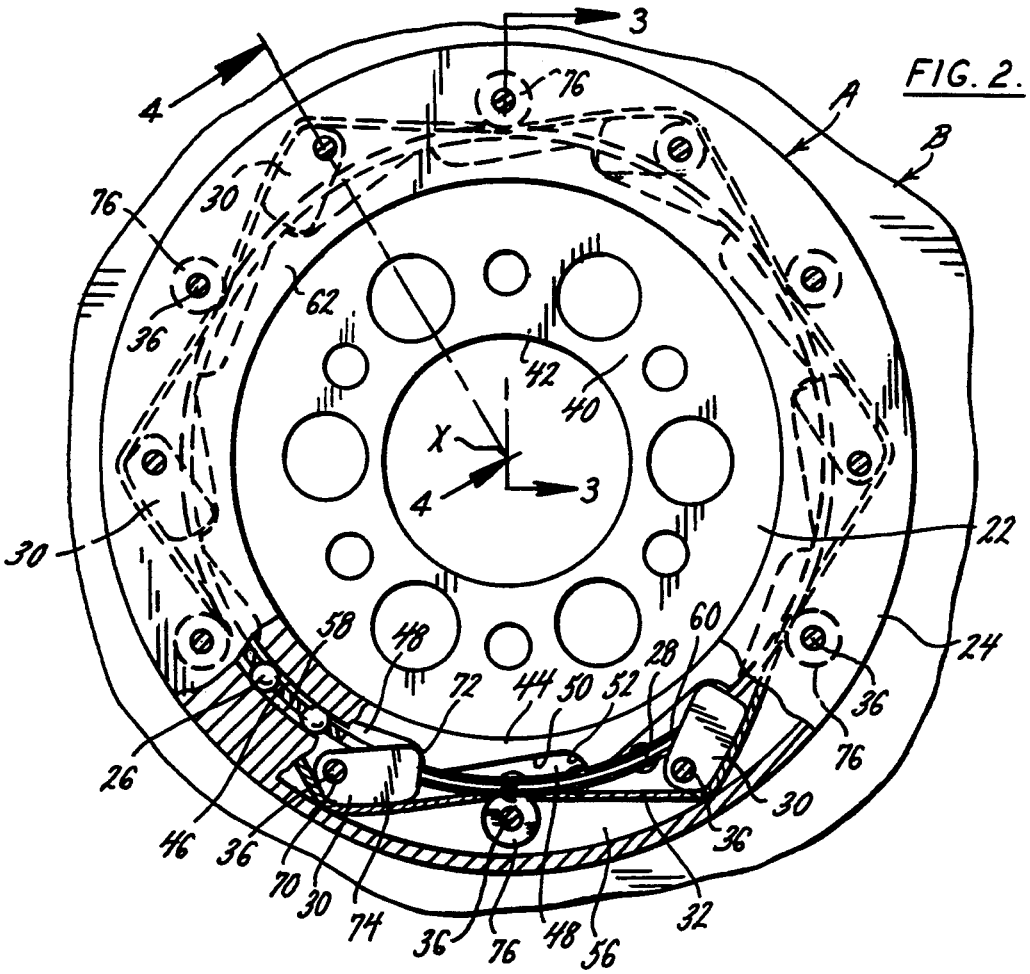
FIG. 2 is an end view of the coupler, partially broken away and in section, taken along line 2—2 of FIG. 1.

Referring now to the drawings, a starter coupler A (FIG. 1) temporarily couples a ring gear 2 on a flexplate 4 with a drive flange 6 on the end of a crankshaft 8 that forms part of an internal combustion engine B to enable a cranking motor 10, which is also part of the engine B, to rotate the crankshaft 8 and thereby start the engine B. The crankshaft 8 rotates about an axis X of rotation and delivers its power through a clutch C which is bolted to the drive flange 6 immediately beyond coupler A. The cranking motor 10 has a pinion 12, and when the motor 10 is energized, the pinion 12 moves axially into engagement with the ring gear 2, rotating the same as well as the flexplate 4 to which it is welded. The coupler A connects the flex plate 4 with the flange 6 on the crankshaft 8 such that torque imparted to the ring gear 2 and flexplate 4 by the cranking motor 10 is transmitted to the crankshaft 8 and turns the same. Cranking speeds are quite low, usually about 130 rev/min, but once the engine B starts, the crankshaft 8 and the flexplate 4 rotate much faster than that, even at idle which is usually at about 900 rev/min. At these higher velocities, the coupler A disengages the flexplate 4 and the ring gear 2 from the flange 6 on the crankshaft 8, so that the crankshaft 8 is not encumbered by the inertia of the flexplate 4 and the ring gear 2.

In contrast to traditional flexplates of the type used on crankshafts that are coupled to automatic transmissions, the flexplate 4 has a larger center hole 16, the diameter of which exceeds the diameter of the flange 6 on the crankshaft 8. This enables the flexplate 4 to fit around the flange 6 instead of against it. The flexplate 4 contains an annular groove 18 (FIGS. 1, 3 & 4) which encircles the hole 16, lying concentric to it, and opens away from the engine B and toward the clutch C. The ring gear 2 is welded to the flexplate 4 at the periphery of the flexplate 4 and is considerably thicker. The ring gear 2 has its center at the axis X of rotation.

The coupler A, which connects the flexplate 4 with flange 6 at the end of the crankshaft 8, has several basic components, namely (FIG. 2) an inner race or hub 22, an outer race or drive ring 24, rolling elements in the form of balls 26 located between the hub 22 and drive ring 24 to enable the one to rotate easily relative to the other, a cage 28 to maintain the proper spacing between the balls 26, dogs or pawls 30 which engage the drive ring 24 with the hub 22 when the drive ring 24 is turned at low velocities, and a spring 32 which urges the pawls 30 inwardly toward the axis X. The hub 22 is attached to the flange 6 of the crankshaft 8 with bolts 34 (FIGS. 1 & 3) which also serve to attach the clutch C to the crankshaft 8, and that clutch may take the form of the clutch disclosed in U.S. Pat. No. 4,907,685. The drive ring 24, on the other hand, is secured to the flexplate 4 with machine screws 36 and nuts 38 which lie along a screw circle that is immediately beyond the annular groove 18.

Figure 3:
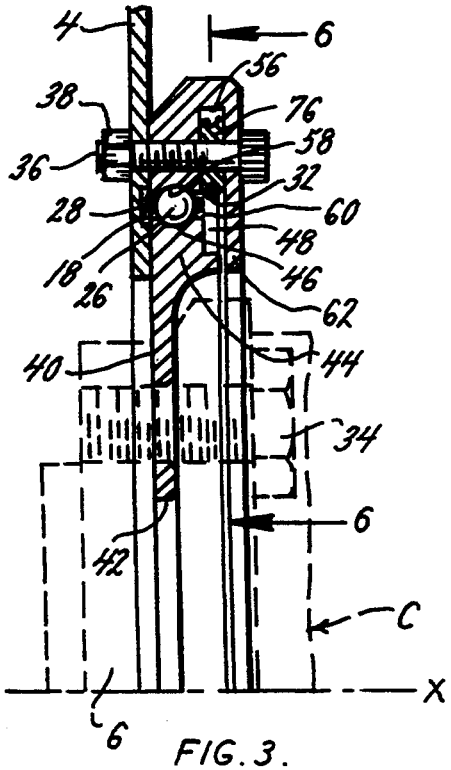
FIG. 3 is a sectional view of the coupler taken along line 3—3 of FIG. 2.

The hub 22 is somewhat dish-shaped, it having a flat center portion 40 provided with a hole 42 and a thicker rim 44 surrounding the center portion 40, with the rim 44 projecting axially in one direction from the center portion 40 to impart the dish shape (FIGS. 1–3). The hub 22 fits against the flange 6 with its dish-shaped interior opening away from the flange 6, it being attached to the flange with the bolts 34 (FIG. 3). The hole 42 receives a boss on the flange 6 of the crankshaft 8, and this serves to center the hub 22 and indeed the entire coupler A radially with respect to the crankshaft 8 and axis X. The rim 44 along one of its ends—that is, the end that lies directly beyond the center portion 40—has a raceway 46 which takes the form of a groove. The raceway 46 opens radially outwardly away from the axis X of rotation and is configured to accommodate the balls 26. At its opposite end—and to one side of the raceway 46—the rim 44 is provided with a succession of notches 48 arranged at equal circumferential intervals around the rim 44. Each notch 48 opens radially outwardly and also axially in the same direction that the dished interior of the hub 22 opens. Moreover, each notch 48 has ramp 50 that lies at a relatively small angle with respect to the periphery of the rim 44 and a somewhat abrupt end 52 located at a greater angle (FIGS. 2 & 5).

Figure 4:
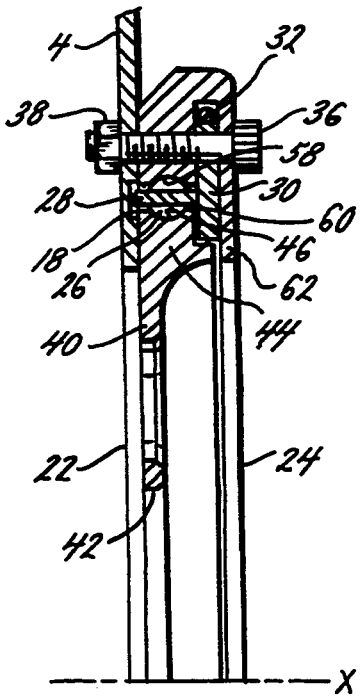
FIG. 4 is a sectional view of the coupler taken along line 4—4 of FIG. 2.

The drive ring 24 fits around the hub 22 and against the flexplate 4 to which it is attached with the machine screws 36 and nuts 38 (FIGS. 3 & 4). Indeed, the ring 24 fits against that surface of the flexplate 4 out of which the annular groove 18 opens. Both the drive ring 24 and the hub 22 are located beyond the flexplate 4 in the sense that they are on that face of flexplate 4 that is presented toward the clutch C.

The drive ring 24 contains a pawl groove 56 (FIGS. 3 & 5) and a raceway 58 located side-by-side within it, each opening inwardly toward the axis X of rotation. The raceway 58 is only slightly larger then the raceway 46 on the rim 44 of the hub 22, and indeed the two raceways 46 and 58 face each other across a small annular gap 60 (FIGS. 2—4). The raceway 58 is likewise configured to accommodate the balls 26. The drive ring 24 is attached to the flexplate 4 with the raceway 58 closest to the flexplate 4 and when so attached the gap 60 between the hub 22 and the ring 24 registers with the annular groove 18 in the flexplate 4. The diameter of the ring 24 at its opposite end, that is along the pawl groove 56, is somewhat less, for here the drive ring 24 is provided with a lip 62 that is small enough to totally obscure the rim 44 of the hub 22, leaving only the dish-shaped center portion 40 exposed. The hub 22, while being encircled by the drive ring 24, is further captured axially between flexplate 4 and the lip 62. This arrangement is such that the hub 22 can be inserted in only one end of the drive ring 24, that is the end along which the raceway 58 lies, and hence the drive ring 24 must be detached from the flexplate 4 in order to install the hub 22 in or remove it from the drive ring 24.

Whereas the raceway 58 of the drive ring 24 opens toward the raceway 46 on the rim 44 of the hub 22, the pawl groove 56 of the drive ring 24 opens toward the notches 48 in the rim 44 of the hub 22. The groove 56 extends outwardly beyond the screw circle formed by the machine screws 36 which attach the drive ring 24 to the flexplate 4, and those screws 36 actually pass axially through the groove 56 and thread into the ring beyond the groove 56.

The balls 26 lie along and between the raceways 46 and 58 on the hub 22 and drive ring 24, respectively, and serve to locate ring 24 radially with respect to the hub 22 while still permitting the hub 22 to rotate within the ring 24. Inasmuch as the raceways 46 and 58 are concave in cross section, the balls 26 further serve to locate the drive ring 24 axially on the hub 22, that is, they prevent the drive ring 24 from moving axially on the hub 22. To load the balls 26 into the gap 60 between the two raceways 46 and 58 during assembly of the coupler A, one simply offsets the hub 22 to an eccentric position with respect to the drive ring 24 so that the gap 60 is larger at one side of the hub 22 than on the other—indeed large enough to receive the balls 26. The full complement of balls 26 is then inserted into the enlarged portion of the gap 60, whereupon the balls 26 are spread generally uniformly along the raceways 46 and 58 and this serves to bring the hub 22 concentric with respect to the drive ring 24 so that they share the same axis X of rotation—and of course the gap 60 assumes a uniform size.

The cage 28 constitutes nothing more than a circular band which is small enough to fit loosely into the gap 60. It contains pockets 66 (FIG. 5) which open out of one of its edges, but not the other, and these pockets 66 are large enough to receive the balls 26 which they do. Thus, the cage 28 maintains the uniform spacing between the balls 26, and this serves to preserve the concentricity between the hub 22 and drive ring 24. The cage 28 along its continuous edge projects axially slightly out of the gap 60 between the hub 22 and drive ring 24 and into the groove 18 in the flexplate 4 (FIGS. 3 & 4), but the flexplate 4 prevents the cage 28 from being displaced from the gap 60.

The pawls 30 lie within the pawl groove 56 of the drive ring 24 where they pivot on the machine screws 36 that secure the drive ring 24 to the flexplate 4, there being a pawl 30 on every other screw 36 (FIG. 2). Each pawl 30 is somewhat trapezoidal in configuration and has a bore 70 at one corner for receiving screw 36 on which it pivots (FIG. 5). The opposite end of the pawl 30 is somewhat pointed to establish a nose 72 which is directed generally away from the screw 36 so it can engage the rim 44 of the hub 22 at one of the notches 48 in that rim 44. The nose 72 also projects away from a back edge 74 which is presented generally away from the axis X of rotation.

The remaining machine screws 36, that is the ones that are not fitted with the pawls 30, hold small sheaves 76 which likewise lie within the pawl groove 56 (FIGS. 2–3). Thus the pawls 30 and sheaves 76 are arranged alternately through the pawl groove 56. Each is about as wide as the pawl groove 56 so that the pawls 30 and sheaves 76 are confined axially, yet can rotate in the groove 56. The spring 32 is a simple garter spring which winds through the pawl groove 56, looping over the back edges 74 of the pawls 30 and under the sheaves 76 (FIG. 2). Indeed, the sheaves 76, by directing the spring 32 inwardly, toward the axis X of rotation between the pawls 30, maintain the spring 32 against the back edges 74 of the pawls 30. The spring 32, being under tension, thereby urges the noses 72 at the pawls 30 inwardly toward the axis X of rotation.

The spring 32 exerts enough force on the back edge 74 of each pawl 30 to hold the nose 72 of the pawl 30 in the closest notch 48 of the rim 44 on the hub 22, at least when the coupler A is at rest or rotating no faster than the cranking speed imparted to the crankshaft 8 by the cranking motor 10. On the other hand, the tension in the spring 32 is not so great as to prevent the pawls 30 from rotating outwardly under the centrifugal forces imposed upon them at normal operating velocities, and even at the idle velocity, for the crankshaft 8—indeed rotating far enough to completely withdraw the noses 72 of the pawls 30 from the notches 48 in the rim 44 of the hub 22 (FIG. 6).

The coupler A serves merely as a coupling for transmitting torque from the cranking motor 10 to the crankshaft 8. When the crankshaft 8 and coupler A are at rest, the pawls 30 in the pawl groove 56 of the drive ring 24 project inwardly into the notches 48 in the rim 44 of the hub 22 (FIG. 2). Once the cranking motor 10 is energized, its pinion 12 engages the ring gear 2, turning the ring gear 2 and the flexplate 4 and drive ring 24 as well, with the direction of rotation being such that it drives the noses 72 on the pawls 30 into the abrupt ends 52 of the notches 48. As a consequence the torque applied to the ring gear 2 is transmitted to the hub 22, and the hub 22 rotates with the drive ring 24. Being attached firmly to the flange 6 on the crankshaft 8, the hub 22 transmits the starting torque to the crankshaft 8 and the crankshaft 8 likewise rotates at the relatively slow starting velocity.

Once the engine B starts, the cranking motor 10 is no longer necessary and it is deenergized. At this time the pinion 12 moves axially out of engagement with the ring gear 2. The pawls 30 initially remain in notches 48 in the rim 44 of the hub 22, but now the torque is transmitted in the opposite direction—from the rotating hub 22 to the drive ring 24. In this regard, enough friction exists between the ramps 50 of the notches 48 and the pawls 30 to impart rotation to the drive ring 24 and flexplate 4, at least while the crankshaft 8 rotates at relatively low velocities. Any acceleration at this time will simply cause the ramps 50 of the notches 48 to pass under the pawls 30 and in so doing drive them outwardly against the bias of spring 32 (FIG. 6). Having a relatively high moment of inertia, the drive ring 24, flexplate 4 and ring gear 2 tend to remain at the original velocity. Thus, the crankshaft 8 can accelerate without being subjected to the inertia of the drive ring 24, flexplate 4 and ring gear 2, which is relatively high, owing to the mass of these components and the concentration of that mass well beyond the axis X of rotation.

Nevertheless, some friction remains between the pawls 30 on the drive ring 24 and the ramps 50 on the rim 44 of the hub 22 and likewise between the balls 26 and the raceways 46 and 58 on the hub 22 and drive ring 24, respectively, and that friction causes the drive ring 24 to be carried along and experience greater velocity. The pawls 30, of course, rotate with the drive ring 24, and they experience the centrifugal force generated by the rotation of the drive ring 24. This force acts on the pawls 30 such that they pivot away from the rim 44 of the hub 22 and their noses 72 withdraw from the notches 48 in the rim 44, notwithstanding the bias of the spring 32. Indeed, at a velocity only slightly beyond idle, the centrifugal force on the pawls 30 is great enough to maintain the pawls 30 completely withdrawn from the notches 48 (FIG. 6).

Thus, the coupler A enables the crankshaft 8 to rotate completely independently of the flexplate 4 and ring gear 2 and also independently of the substantial inertia that the flexplate 4 and ring gear 2 possess. Yet the ring gear 2 and flexplate 4 serve their intended purpose, that is, to transfer the torque of the cranking motor 10 to the crankshaft 8 so as to start the engine B.

The hub 22, drive ring 24, balls 26 and pawls 30 are all preferably manufactured from high quality bearing steel which is either through hardened or case carburized. The cage 28 is preferably formed from bronze.

This invention is intended to cover all changes and modifications of the example of the invention herein chosen for purposes of the disclosure which do not constitute departures from the spirit and scope of the invention.

What is claimed is:

1. A coupler for connecting a starting motor to a shaft from which power is derived from an internal combustion engine, said coupler comprising: a first member capable of being connected to the shaft; a second member located adjacent to and around the first member and being capable of transferring torque generated by the starting motor; bearing means for enabling one member to rotate relative to the other member; and engaging means for engaging the members so that they will rotate in unison when torque is applied to the second member in one direction while the first member is initially at rest and for allowing the first member to rotate in the same direction relative to second member at a greater velocity than that of the second member, the engaging means including notches on the first member and pawls carried by the second member, with the pawls and notches being configured such that the pawls engage the notches when the second member is turned relative to the first member at low angular velocity, whereby the first member will rotate with the second member.

2. A coupler according to claim 1 wherein the notches open away from the axis of rotation and the pawls are urged away from the notches by the centrifugal force imposed on the pawls by reason of their rotation with the second member; and further comprising biasing means for urging the pawls into the notches in opposition to the centrifugal force on the pawls.

3. A coupler according to claim 2 wherein the biasing means holds the pawls in the notches at relatively low velocities of the second member, but not at higher velocities where the centrifugal force imparted to the pawls is greater and overcomes the force of the biasing means.

4. A coupler according to claim 3 wherein the biasing means is a garter-type spring which extends around the complement of pawls and urges them inwardly toward the axis of rotation.

5. A coupler according to claim 2 wherein the bearing means comprises an outwardly presented raceway on the first member, an inwardly presented raceway on the second member, and rolling elements between the raceways.

6. In combination with an internal combustion engine having a crankshaft, a cranking motor provided with a pinion, a ring gear located such that the pinion will engage it, and a plate located within the ring gear for supporting the ring gear, a coupling device for transmitting a starting torque applied to the ring gear and plate from the plate to the crankshaft, said coupling device comprising: a hub attached to the crankshaft and having outwardly opening notches; a drive ring mounted on and around the hub such that it can rotate relative to the hub and vice versa, the drive ring further being attached to the plate so as to support the plate and ring gear on the hub; pawls carried by the drive ring and aligned with the notches on the hub, the pawls being movable on the drive ring such that they can move into and out of the notches, the pawls and the notches being configured such that the pawls engage the hub at the notches when the drive ring is rotated in one direction, while the hub is initially at rest, so that the rotation of the drive ring is imparted to the hub, but disengage the hub from the drive ring when the hub rotates in that one direction at a greater velocity than the drive ring, the one direction of rotation being that which is imparted to the drive ring by the pinion of the cranking motor.

7. The combination according to claim 6 wherein the pawls pivot on the drive ring.

8. The combination according to claim 7 and further comprising a spring for urging the pawls into the notches.

9. The combination according to claim 8 wherein the pawls are urged out of the notches when subjected to centrifugal force developed during rotation of the drive ring and the spring allows the pawls to move out of the notches under the centrifugal force at an angular velocity greater than that imparted to the drive ring by the cranking motor.

10. The combination according to claim 8 wherein the pawls are urged out of the notches when subjected to centrifugal force developed during rotation of the second member and the spring allows the pawls to move out of the notches under the centrifugal force at a velocity greater than that imparted to the second member by the cranking motor.

11. The combination according to claim 6 wherein the hub has an outwardly presented raceway and the drive ring has an inwardly presented raceway which faces and encircles the raceway of the hub, and further comprising rolling elements located along and between the raceways of the hub and drive ring and a cage located between the raceways and having pockets in which the rolling elements fit, whereby a prescribed spacing is maintained between the rolling elements.

12. The combination according to claim 11 wherein the pockets open out of one end of the cage and the other end of the cage rotates adjacent to the plate and the plate prevents the cage from moving axially out of the space between the raceways.

13. A coupler for connecting a starting motor with a shaft from which power is derived from an internal combustion engine, said coupler comprising: a hub that is capable of being attached to the shaft and has a rim provided with an outwardly presented raceway and outwardly opening notches arranged circumferentially around the rim adjacent to the notches, each notch being defined by a ramp located at a relatively small angle with respect to the periphery of the hub and a generally abrupt end located at a substantially greater angle with respect to the periphery of the hub; a drive ring encircling the hub at its rim and arranged such that it can be rotated by the starting motor, the drive ring having a raceway which is presented inwardly toward the raceway on the hub and a groove which opens inwardly opposite the notches on the hub; rolling elements located between and along the raceways of the hub and drive ring for enabling the hub to rotate easily within the drive ring; pivots on the drive ring where they extend axially through the inwardly opening groove; pawls located within the groove where they turn on the pivots, each pawl having a nose located remote from the pivot for that pawl and being capable of rotating between an engaged and a disengaged position, the pawl when in its engaged position having its nose projected into a notch opposite the abrupt end of that notch, so that when the drive ring rotates in one direction, the nose comes against the abrupt end of the notch, whereby the rotation of the drive ring is imparted to the hub, the pawl when in its disengaged position being withdrawn from the notches so that the hub can rotate within the drive ring in the same direction at a velocity greater than that of the drive ring.

14. A coupler according to claim 13 and further comprising biasing means for urging the pawls to their engaged position.

15. A coupler according to claim 14 wherein the biasing means is a spring.

16. A coupler according to claim 15 wherein the mass of the pawls and the location of the pivots with respect to the pawls is such that the pawls, under the influence of centrifugal force, will move to their disengaged positions when the drive ring reaches a velocity greater than the velocity at which it is normally turned by a cranking motor.

17. A coupler according to claim 14 wherein the biasing means is a garter-type spring which lies within the pawl groove and extends over the pawls to urge the pawls inwardly toward their engaged positions.

18. A coupler according to claim 17 and further comprising diverting means located between adjacent pawls for diverting the garter-type spring inwardly toward the rim of the hub between adjacent pawls, so that the spring bears against the pawls and urges them inwardly.

19. A coupler according to claim 18 wherein the pivot elements are and the diverting means include machine screws which extend axially through the drive ring and the pawl groove within the drive ring.

20. In combination with an internal combustion engine having a crankshaft, a cranking motor provided with a pinion, and with a ring gear located such that the pinion will engage it, a coupling device for transmitting a starting torque applied to the ring gear to the crankshaft, said coupling device comprising: a first member attached to the crankshaft and having outwardly opening notches; a second member mounted on the hub such that it can rotate relative to the hub and vice versa, the second member further carrying the ring gear such that the ring gear will not rotate relative to the second member; pawls carried by the second member and being aligned with the notches on the first member; the pawls being movable on the second member such that they can move into and out of the notches in the first member, the pawls and the notches being configured such that the pawls engage the first member at the notches when the second member is rotated in one direction, while the first member is initially at rest, so that the rotation of the second member is imparted to the first member, but disengage the first member from the second member when the first member rotates in that one direction at a greater velocity than the second member, the one direction of rotation being that which is imparted to the second member by the pinion of the cranking motor.

21. The combination according to claim 20 wherein the pawls pivot on the second member.

22. The combination according to claim 20 and further comprising a spring carried by the second member and urging the pawls into the notches.

* * * * *